US006767871B2

(12) United States Patent
Devlin et al.

(10) Patent No.: US 6,767,871 B2
(45) Date of Patent: Jul. 27, 2004

(54) DIESEL ENGINE LUBRICANTS

(75) Inventors: Mark Thomas Devlin, Richmond, VA (US); Charles A. Passut, Midlothian, VA (US); Carl K. Esche, Jr., Richmond, VA (US); John T. Loper, Richmond, VA (US)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 10/225,040

(22) Filed: Aug. 21, 2002

(65) Prior Publication Data

US 2004/0038836 A1 Feb. 26, 2004

(51) Int. Cl.[7] ..... C10M 137/10; C10M 149/00

(52) U.S. Cl. ..... 508/371; 508/375; 508/470; 508/545

(58) Field of Search ..... 508/371

(56) References Cited

U.S. PATENT DOCUMENTS

| | | | | | |
|---|---|---|---|---|---|
| 3,915,871 | A | | 10/1975 | Bryer et al. | |
| 3,923,669 | A | | 12/1975 | Newingham et al. | |
| 4,101,428 | A | * | 7/1978 | Crawford | 508/371 |
| 4,455,243 | A | | 6/1984 | Liston et al. | |
| 4,466,895 | A | * | 8/1984 | Schroeck | 508/368 |
| 4,606,834 | A | * | 8/1986 | Hart et al. | 508/471 |
| 4,904,401 | A | | 2/1990 | Ripple et al. | |
| 4,957,649 | A | | 9/1990 | Ripple et al. | |
| 5,075,383 | A | | 12/1991 | Migdal et al. | |
| 5,112,509 | A | | 5/1992 | Brink et al. | |
| 5,139,688 | A | | 8/1992 | Nalesnik | |
| 5,238,588 | A | | 8/1993 | Nalesnik et al. | |
| 5,534,175 | A | | 7/1996 | Cantiani | |
| 5,955,405 | A | | 9/1999 | Liesen et al. | |
| 5,972,853 | A | * | 10/1999 | Boffa et al. | 508/371 |
| 6,004,910 | A | * | 12/1999 | Bloch et al. | 508/294 |
| 6,010,986 | A | * | 1/2000 | Stachew et al. | 508/185 |
| 6,107,257 | A | | 8/2000 | Valcho et al. | |
| 6,107,258 | A | * | 8/2000 | Esche et al. | 508/231 |
| 6,114,288 | A | | 9/2000 | Fujitsu et al. | |
| 6,569,821 | B1 | * | 5/2003 | Ibrahim et al. | 508/396 |
| 2001/0036906 | A1 | | 11/2001 | Locke et al. | |

FOREIGN PATENT DOCUMENTS

| | | |
|---|---|---|
| EP | 0 206 748 A2 | 12/1986 |
| EP | 0 277 729 A1 | 8/1988 |
| EP | 1 195 427 A2 | 4/2002 |

OTHER PUBLICATIONS

"Wear Mechanism in Cummins M–11 High Soot Diesel Test Engines," by C.C. Kuo, C.A. Passut, T–C Jao, A.A. Csontos and J.M. Howe (SAE Technical Paper 981372).

* cited by examiner

*Primary Examiner*—Ellen M. McAvoy
(74) *Attorney, Agent, or Firm*—Dennis H. Rainear; Leah O. Robinson

(57) ABSTRACT

The lubricating oil of the present invention has a viscosity suitable for use in a diesel engine and includes at least one functionalized olefin polymer, and at least one zinc dialkyl dithiophosphate (ZDDP). The ZDDP is made from a mixture of primary alcohols or a mixture of primary and secondary alcohols, wherein the lubricant has a high boundary film value greater than or equal to 15, and preferably greater than 60, as measured by using a High Frequency Reciprocating Rig (HFRR).

28 Claims, No Drawings

DIESEL ENGINE LUBRICANTS

TECHNICAL FIELD

This invention provides a combination of anti-wear agents and polymers to form diesel engine lubricants with unique boundary films in the presence of abrasive contaminants.

BACKGROUND OF THE INVENTION

In order to prevent wear, lubricants may form sacrificial films on rubbing surfaces. Zinc dialkyl dithiophosphates (ZDDP) are the most common anti-wear agents used in lubricants that act in this manner. However, in modern diesel engines and in off-road applications contaminants are usually present in the lubricant and can cause abrasive wear. The sacrificial films formed by lubricant additives must therefore be tenacious. We have discovered that there are specific combinations of ZDDP and polymers that can work synergistically to form tenacious boundary films. Zinc dialkyl dithiophosphates are well known in the art. For example, see U.S. Pat. Nos. 4,904,401; 4,957,649 and 6,114,288, which are incorporated herein by reference in their entirety.

SUMMARY OF THE INVENTION

This invention is a lubricating oil composition comprising a major amount of an oil of lubricating viscosity and a minor amount of a combination of at least one functionalized polymer, and at least one zinc dialkyl dithiophosphate (ZDDP), wherein the ZDDP is made from a mixture of primary alcohols or a mixture of primary and secondary alcohols, wherein the lubricating composition has a high boundary film result as measured by using a High Frequency Reciprocating Rig (HFRR), of greater than or equal to 15, preferably greater than 20, more preferably greater than 30, and most preferably greater than 60.

Preferably, the lubricating composition has a viscosity suitable for use in lubricating a diesel engine. Also, the preferred functionalized polymers are an amine-capped, grafted olefin copolymer or a copolymer of non-functionalized and functionalized methacrylate monomers. Preferably, the ZDDP is made from a mixture of primary alcohols or a mixture of primary and secondary alcohols.

DETAILED DESCRIPTION OF THE INVENTION

The boundary friction properties of lubricating fluids can be measured using a High Frequency Reciprocating Rig (HFRR). The formation of sacrificial boundary films and their tenacity can also be measured using the HFRR. The HFRR is well known in the lubricant industry and in general operates by oscillating a ball across a plate in a sample cell containing 1–2 ml of sample lubricant fluid. The frequency of oscillation, path length that the ball travels, load applied to the ball and test temperature can be controlled. A current runs through the ball and disk. When a boundary film is formed the current is reduced and the percent resistance is measured. The higher the percent resistance the more tenacious the boundary film.

In an embodiment of the present invention, the novel combinations of the present invention were blended in a Group II basestock which contains less than 0.02 wt. % sulfur and less than 5.0 wt. % aromatics. In a preferred embodiment, the lubricating base oil has a kinematic viscosity at 100° C. of between 2.0 and 15.0 cSt. The boundary film formation properties of these fluids were assessed using an HFRR under the same conditions described in "Wear Mechanism in Cummins M-11 High Soot Diesel Test Engines" by C. C. Kuo, C. A. Passut, T-C Jao, A. A. Csontos and J. M. Howe (SAE Technical Paper 981372), that is, 1 N load, 2 mm path length and 20 Hz frequency. The film formation properties were measured at 116° C.

The functionalized olefin polymers used in one embodiment of the present invention are preferably amine capped, highly grafted, olefin copolymers comprising a grafted and amine-derivatized copolymer prepared from ethylene and at least one $C_3$ to $C_{23}$ alpha-monoolefin and, optionally, a polyene; wherein the copolymer of ethylene and at least one $C_3$ to $C_{23}$ alpha-monoolefin has grafted thereon at least one carboxylic acid group, preferably maleic anhydride, per polymer molecule which is subsequently reacted with a capping amine. The olefin copolymer useful in the present invention can in one embodiment have a number average molecular weight of between about 5,000 and about 150,000. The functionalized olefin copolymers useful herein are fully described in U.S. Pat. Nos. 5,075,383; 5,139,688; 5,238,588 and 6,107,257, which are herein incorporated by reference in their entirety.

The functionalized polymethacrylate copolymers, if used in the present invention, can be prepared by copolymerization of non-functionalized and functionalized methacrylate monomers. Specifically, the monomers can be prepared from a mixture of $C_4$ to $C_{20}$ methacrylates and dispersant monomers. The resulting copolymer has a preferred number average molecular weight between about 20,000 and about 200,000. The functionalized polymethacrylate polymers are fully described in U.S. Pat. Nos. 4,606,834; 5,112,509; 5,534,175 and 5,955,405, which are herein incorporated by reference in their entirety.

The ZDDP used in the present invention may be made from a mixture of primary alcohols, or a mixture of primary and secondary alcohols. Examples of commercial ZDDP's that may be used include but are not limited to HiTEC® 7169, a secondary ZDDP, HiTEC® 7197, HiTEC® 680 and HiTEC® 682, all primary ZDDP's, and HiTEC® 1656, a mixed primary/secondary ZDDP, all available from Ethyl Corporation.

In evaluating the antiwear performance of the lubricating oils of the present invention, carbon black is added as an abrasive contaminant to the oils and percent resistance is measured in the presence of the carbon black. Carbon black is used as a mimic for soot. In modern heavy-duty diesel applications as oil is aged, as much as 6 wt. % soot or higher is undesirably added to the oils, so the lubricants shown in the examples herein each contain 6 wt. % carbon black.

The examples shown below illustrate preferred combinations of these additives to form tenacious boundary films according to the present invention. The fluids in all examples are ZDDP's synthesized with only secondary alcohols, with only primary alcohols, and with a 60/40 mixture of primary and secondary alcohols, respectively.

In the following examples, the formulation contained the following components:

- AA is a zinc dialkyldithiophosphate made from a 50/50 mixture of C3 secondary alcohol and C6 secondary alcohol. The final product contains 9.0 wt. % Zn and 8.2 wt. % P.
- BB is a ZDDP made with 65 wt. % C4 primary alcohol, 25 wt. % C5 primary alcohol and 10 wt. % C8 primary alcohol. The final product contains 9.0 wt. % Zn and 8.4 wt. % P.
- CC is a ZDDP made from 40 wt. % C3 secondary alcohol, 40 wt. % C4 primary alcohol and 20 wt. % C8 primary alcohol. The final product contains 9.2 wt. % Zn and 8.4 wt. % P.

DD is a styrene-isoprene linear copolymer. This polymer contains no nitrogen and is considered to be a non-dispersant copolymer. We examined this polymer since it is the most common polymer used in heavy-duty diesel engine oils.

EE (HiTEC® H5777) is described fully in U.S. Pat. Nos. 5,139,688 and 6,107,257. It is a highly grafted, amine derivatized functionalized ethylene-propylene copolymer.

FF (HiTEC® H5710) is described fully in U.S. Pat. Nos. 4,606,834; 5,112,509; 5,534,175 and 5,955,405. It is a polymethacrylate polymer made from C4, C12 to C20 monomers and an amine containing monomer with a total nitrogen content in the final product being ~0.3 wt. %.

The samples contained 2 wt. % ZDDP and 1 wt. % polymer. All samples are blended in a Group II basestock which contains less than 0.02 wt. % sulfur and less than 5.0 wt. % aromatics.

The following Examples A to F show HFRR film values for individual components. Examples G to N show actual and predicted film values for combinations of components, based on their separate individual effects.

EXAMPLES A TO F

These samples show the HFRR film results for the individual components we used in our examples. The higher the HFRR result the more tenacious the film which is formed.

| Example | ZDDP | Polymer | Actual HFRR Film Result |
|---|---|---|---|
| A | AA | — | 15 |
| B | BB | — | 1 |
| C | CC | — | 11 |
| D | — | DD | 17 |
| E | — | EE | 8 |
| F | — | FF | 53 |

Examples A, B and C show that ZDDP's form boundary films whose HFRR results are less than or equal to 15 in the presence of 6 wt. % carbon black.

Examples D and E show that unfunctionalized polymers and functionalized olefin copolymers form films of comparable tenacity to ZDDP films.

Example F shows that functionalized polymethactylates form lubricants of the present invention with more tenacious films than conventional lubricants containing ZDDPs and other polymers.

EXAMPLES G TO N

Using the data from the performance of individual components we can predict the performance for the combination of ZDDPs and polymers by addition of the individual results. For example, a combination of a ZDDP synthesized from only secondary alcohols (AA) and an unfunctionalized polymer (DD) should have a film result of 32 (15+17). Example G shows that this combination has an actual result of 7, which is less than expected if the effects of the components are additive, that is, the predicted value is that obtained by adding together the known effects of each component in the combination.

| Example | ZDDP | Polymer | Actual HFRR Film Result | Predicted HFRR Film Result |
|---|---|---|---|---|
| G | AA | DD | 7 | 32 |
| H | BB | DD | 24 | 18 |
| I | AA | EE | 17 | 23 |
| J | AA | FF | 68 | 68 |
| K | BB | EE | 69 | 9 |
| L | BB | FF | 87 | 54 |
| M | CC | EE | 84 | 19 |
| N | CC | FF | 90 | 64 |

Example H shows that the combination of unfunctionalized polymer and ZDDP synthesized from only primary alcohols has an actual result of 24 which is comparable to the predicted result of 18, which is within the 90% confidence level of the film measurement (+/−10).

Example I shows that a combination of a functionalized olefin copolymer and a ZDDP synthesized from only secondary alcohols forms films comparable to those predicted for the combination of the individual components. Similarly, example J shows that a combination of functionalized polymethacrylate and a ZDDP synthesized from only secondary alcohols forms films comparable to those predicted from the combination of the individual components.

Unexpectedly, when ZDDP synthesized from only primary alcohols is combined with a functionalized olefin copolymer (example K) or a functionalized polymethacrylate (example L), the combinations form lubricants exhibiting more tenacious films than would be predicted from the combination of the individual components.

Examples M and N show that the unexpected synergism between functionalized polymers and ZDDP synthesized from primary alcohols also occurs when the ZDDP tested is synthesized from a mixture of primary and secondary alcohols. In these examples, but not as a limitation herein, the amount of primary alcohol in the ZDDP is less than 60 wt. %.

The data shows this invention is useful in heavy-duty diesel engine oil formulations. The combination of ZDDP with specific functionalized polymers enhances the ability of the heavy-duty diesel engine oils to prevent wear in the presence of contaminants.

The inventors do not intend to dedicate any disclosed embodiments to the public, and to the extent any disclosed modifications or alterations may not literally fall within the scope of the claims, they are considered to be part of the invention under the doctrine of equivalents.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A lubricant suitable for use in a diesel engine comprising:

a lubricating oil having a viscosity suitable for use in a diesel engine;

at least one functionalized polymer comprising an amine capped functionalized ethylene-propylene copolymer having a number average molecular weight ranging from about 5,000 to about 150,000; and a zinc dialkyl dithiophosphate (ZDDP) wherein the ZDDP is made from a mixture of primary alcohols or a mixture of primary and secondary alcohols, wherein the lubricant has high boundary film value as measured by using a High Frequency Reciprocating Rig (HFRR) of greater than or equal to 6.

2. A lubricant according to claim 1, wherein the lubricating oil has a kinetic viscosity at 100° C. of between 2.0 and 15.0 cSt.

3. A lubricant according to claim 1, wherein the ZDDP is made from a mixture of primary alcohols.

4. A lubricant according to claim 1, wherein the ZDDP is made from a mixture of primary and secondary alcohols.

5. A lubricant according to claim 1, wherein the secondary alcohols used in making the ZDDP comprise a mixture of $C_3$ secondary alcohol and $C_6$ secondary alcohol.

6. A lubricant according to claim 1, wherein the ZDDP is made from a mixture of $C_4$ primary alcohol, $C_5$ primary alcohol and $C_8$ primary alcohol.

7. A lubricant according to claim 1, wherein the ZDDP is made from a mixture of $C_3$ secondary alcohol, $C_4$ primary alcohol and $C_8$ primary alcohol.

8. A lubricant according to claim 1, wherein the HFRR film value is higher than a predicted HFRR film value, when said predicted value is that obtained by adding together the known effects of each component.

9. A concentrate for formulating lubricating oil compositions comprising from about 20% to about 90% by weight of a liquid, substantially inert organic diluent/solvent, and at least one functionalized polymer comprising an amine capped functionalized ethylene-propylene copolymer having a number average molecular weight ranging from about 5,000 to about 150,000 and at least one zinc dialkyl dithiophosphate (ZDDP); wherein the ZDDP is made from a mixture of primary alcohols, or a mixture of primary and secondary alcohols, wherein a mixture of the concentrate and a lubricating oil has a high boundary film value as measured by using a High Frequency Reciprocating Rig (HFRR) of greater than or equal to 6.

10. A method of lubricating a diesel engine comprising the steps of adding to and operating in a crankcase of the diesel engine the lubricant of claim 1.

11. A diesel engine lubricated with the lubricant of claim 1.

12. A lubricant according to claim 1, wherein the functionalized olefin polymer has a number average molecular weight ranging from about 20,000 to about 150,000.

13. A lubricant suitable for use in a diesel engine comprising:

a lubricating oil having a viscosity suitable for use in a diesel engine;

at least one functionalized olefin polymer comprising a copolymer of methacrylate and an amine monomer; and a zinc dialkyl dithiophosphate (ZDDP) wherein the ZDDP is made from a mixture of primary alcohols or a mixture of primary and secondary alcohols, wherein the lubricant has high boundary film value as measured by using a High Frequency Reciprocating Rig (HFRR) of greater than or equal to 15.

14. A lubricant according to claim 13, wherein the HFRR value is greater than or equal to 20.

15. A lubricant according to claim 13, wherein the HFRR value is greater than or equal to 30.

16. A lubricant according to claim 13, wherein the HFRR value is greater than or equal to 60.

17. A lubricant according to claim 13, wherein the lubricating oil has a kinematic viscosity at 1000° C. of between 2.0 and 15.0 cSt.

18. A lubricant according to claim 13, wherein the functionalized olefin polymer has a number average molecular weight ranging from about 5,000 to about 150,000.

19. A lubricant according to claim 3, wherein the ZDDP is made from a mixture of primary alcohols.

20. A lubricant according to claim 13, wherein the ZDDP is made from a mixture of primary and secondary alcohols.

21. A lubricant according to claim 13, wherein the secondary alcohols used in making the ZDDP comprise a mixture of $C_3$ secondary alcohol and $C_6$ secondary alcohol.

22. A lubricant according to claim 13, wherein the ZDDP is made from a mixture of $C_4$ primary alcohol, $C_5$ primary alcohol, and $C_8$ primary alcohol.

23. A lubricant according to claim 13, wherein the ZDDP is made from a mixture of $C_3$ secondary alcohol, $C_4$ primary alcohol, and $C_8$ primary alcohol.

24. A lubricant according to claim 13, wherein the HFRR film value is higher than a predicted HFRR film value, when said predicted value is that obtained by adding together the known effects of each component.

25. A concentrate for formulating lubricating oil compositions comprising from about 20% to about 90% by weight of a liquid, substantially inert organic diluent/solvent, and at least one functionalized polymer comprising a copolymer of methacrylate and an amine monomer and at least one zinc dialkyl dithiophosphate (ZDDP); wherein the ZDDP is made from a mixture of primary alcohols, or a mixture of primary and secondary alcohols, wherein a mixture of the concentrate and a lubricating oil has a high boundary film value as measured by using a High Frequency Reciprocating Rig (HFRR) of greater than or equal to 15.

26. A concentrate according to claim 25, wherein the HFRR value is greater than or equal to 60.

27. A method of lubricating a diesel engine comprising the steps of adding to and operating in a crankcase of the diesel engine the lubricant of claim 13.

28. A diesel engine lubricated with the lubricant of claim 13.

* * * * *

UNITED STATES PATENT AND TRADEMARK OFFICE

CERTIFICATE OF CORRECTION

PATENT NO. : 6,767,871 B2
DATED : July 27, 2004
INVENTOR(S) : Mark Thomas Devlin et al.

It is certified that error appears in the above-identified patent and that said Letters Patent is hereby corrected as shown below:

Column 5,
Line 8, should read -- . . . Rig (HFRR) of greater than or equal to 60. --
Line 41, should read -- . . . (HFFR) of greater than or equal to 60. --

Column 6,
Line 15, should read . . . cating oil has a kinematic viscosity at 100° C. of between . . . --

Signed and Sealed this

Twenty-first Day of December, 2004

JON W. DUDAS
*Director of the United States Patent and Trademark Office*